US006612569B2

(12) United States Patent
Schaum

(10) Patent No.: US 6,612,569 B2
(45) Date of Patent: Sep. 2, 2003

(54) PRINTING UNIT WITH A HOLDING DEVICE ADJUSTABLE INTO THE INTERIOR OF A TRANSPORT DEVICE

(75) Inventor: Frank Schaum, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 36 days.

(21) Appl. No.: 10/026,497

(22) Filed: Dec. 19, 2001

(65) Prior Publication Data

US 2002/0084581 A1 Jul. 4, 2002

(30) Foreign Application Priority Data

Dec. 19, 2000 (DE) ..... 100 63 300

(51) Int. Cl.[7] ..... B65H 9/00; B65H 9/12
(52) U.S. Cl. ..... 271/241; 347/153; 347/215
(58) Field of Search ..... 271/226, 228, 271/268, 277, 241; 400/579; 347/153, 215, 217, 218, 262, 264; B65H 7/02, 9/00, 5/12, 5/02, 9/12

(56) References Cited

U.S. PATENT DOCUMENTS 4,591,143 A * 5/1986 Jeschke ..... 271/227
5,186,107 A * 2/1993 Wieland ..... 101/409
5,764,268 A * 6/1998 Bills et al. ..... 347/213
6,176,484 B1 1/2001 Greive et al.

FOREIGN PATENT DOCUMENTS

| | | | | |
|---|---|---|---|---|
| DE | 2 135 714 | | 3/1972 | |
| DE | 197 04 003 A1 | | 8/1998 | |
| DE | 199 01 698 A1 | | 8/1999 | |
| GB | 1 343 084 | | 1/1974 | |
| JP | 61-132365 | * | 6/1986 | ..... B41J/15/16 |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Gregory L. Mayback

(57) ABSTRACT

A printing unit includes a rotatably mounted transport device for transporting a print carrier sheet in which the transport device is equipped with a holding device for holding a print carrier sheet. The printing unit includes a NIP printing head aligned with the transport device and intended for printing the print carrier sheet. The printing unit is distinguished in that the holding device is mounted to be adjustable into the interior of the transport device.

11 Claims, 3 Drawing Sheets

PRINTING UNIT WITH A HOLDING DEVICE ADJUSTABLE INTO THE INTERIOR OF A TRANSPORT DEVICE

BACKGROUND OF THE INVENTION

Field of the Invention

The invention relates to a printing unit that includes a rotatably mounted transport device for transporting a print carrier sheet. The transport device is equipped with a holding device for holding the print carrier sheet. The printing unit includes a NIP (Non-Impact-Printing) printing head that is aligned with the transport device and is intended for printing the print carrier sheet.

Published German Patent Application DE 197 04 003 A1 describes a printing unit with a transport device designed as an impression cylinder mounted rotatably about its cylinder axis. The holding device of the transport device is designed as a gripper row. The NIP printing head of this printing unit may be a laser printing head or an ink-jet printing head. One disadvantage of the printing unit is that the gripper row permanently projects well beyond the circumferential contour of the impression cylinder. Consequently, the size of the printing nip, that is to say the distance of the NIP printing head from the circumferential surface of the impression cylinder, can be reduced only to the limit which ensures that the gripper row can run through the printing nip without colliding with the NIP printing head.

It is desirable, however, for the NIP printing head to be capable of being advanced beyond this limit nearer to the print carrier sheet, in order to achieve a better pixel geometry of the pixels that are produced on the print carrier sheet with the NIP printing head.

Published German Patent Application DE 199 01 698 A1 likewise describes a printing unit that corresponds to the generic type initially mentioned, in which the transport device is a transport belt that rotates about two deflecting rollers and the holding device is a prestressed gripper tongue. By means of the very flat form of the gripper tongue which can be manufactured, for example, from spring plate, the printing nip can be reduced to a dimension of less than 1 mm. Although a satisfactory pixel quality can be expected, designing the holding device as a gripper tongue is undesirable because of the comparatively low clamping force that is exerted on the print carrier sheet by the gripper tongue. To be precise, the clamping force is determined by the prestress of the gripper tongue, which, in turn, depends on the thickness, for example the spring plate thickness, of the gripper tongue. In order to increase the prestress and the clamping force, therefore, the thickness of the gripper tongue would have to be increased. Consequently, it will be necessary to increase the size of the printing nip, in order to prevent the thickened gripper tongue from colliding with the NIP printing head. Increasing the size of the printing nip would, in turn, be detrimental to the pixel quality, so that the desired aim would not be fulfilled.

SUMMARY OF THE INVENTION

It is accordingly an object of the invention to provide a printing unit which overcomes the above-mentioned disadvantages of the prior art apparatus of this general type.

In particular, it is an object of the invention to provide a printing unit that allows the NIP printing head to be in close proximity with the transport device.

With the foregoing and other objects in view there is provided, in accordance with the invention, a printing unit that includes: a rotatably mounted transport device for transporting a print carrier sheet; and a non-impact-printing printing head for printing the print carrier sheet. The printing head is aligned with the transport device. The transport device is formed with an interior. The transport device includes a holding device for holding the print carrier sheet, and the holding device is adjustably mounted to enable movement of the holding device into the interior of the transport device.

In accordance with an added feature of the invention, the holding device is a gripper system.

In accordance with an additional feature of the invention, the gripper system is opened when the gripper system is in the interior of the transport device.

In accordance with another feature of the invention, a cam mechanism is assigned to the holding device for moving the holding device into the interior of the transport device.

In accordance with a further feature of the invention, the transport device includes a suction device for sucking up the print carrier sheet.

In accordance with a further added feature of the invention, the transport device has a sheet bearing surface; and the suction device has suction orifices that are arranged in rows and that are formed in the sheet bearing surface of the transport device.

In accordance with a further additional feature of the invention, a suction-air source is connected to the suction device.

In accordance with yet an added feature of the invention, the transport device is a transport cylinder.

In accordance with yet an additional feature of the invention, the printing head is an ink-jet printing head.

With the foregoing and other objects in view there is provided, in accordance with the invention, a sheet-fed rotary printing machine, that includes: at least one first printing unit having an impression cylinder and cylinder selected from the group consisting of a rubber-blanket cylinder and a printing-form cylinder; and a second printing unit. The second printing unit includes: a rotatably mounted transport device for transporting a print carrier sheet; and a non-impact-printing printing head for printing the print carrier sheet. The printing head is aligned with the transport device. The transport device is formed with an interior. The transport device includes a holding device for holding the print carrier sheet, and the holding device is adjustably mounted to enable movement of the holding device into the interior of the transport device.

The holding device can thus automatically be adjusted completely into the interior of the transport device shortly before the passage of the NIP printing head and out of the interior again shortly after the passage. This automatic retraction and reemergence of the holding device may take place periodically, that is to say once during each revolution of the transport device. By the holding device being drawn into the transport device, the holding device is adjusted away from the NIP printing head, so that, even when the distance of the NIP printing head from the transport device is very slight, a collision of the holding device with the NIP printing head is absolutely ruled out.

The holding device may be a holding device, for example a suction strip, retaining the print carrier sheet at its leading edge by means of electrostatic or pneumatic attraction.

The NIP printing head may operate according to an electrophotographic NIP (Non-Impact-Printing) method.

Other features which are considered as characteristic for the invention are set forth in the appended claims.

Although the invention is illustrated and described herein as embodied in a printing unit it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
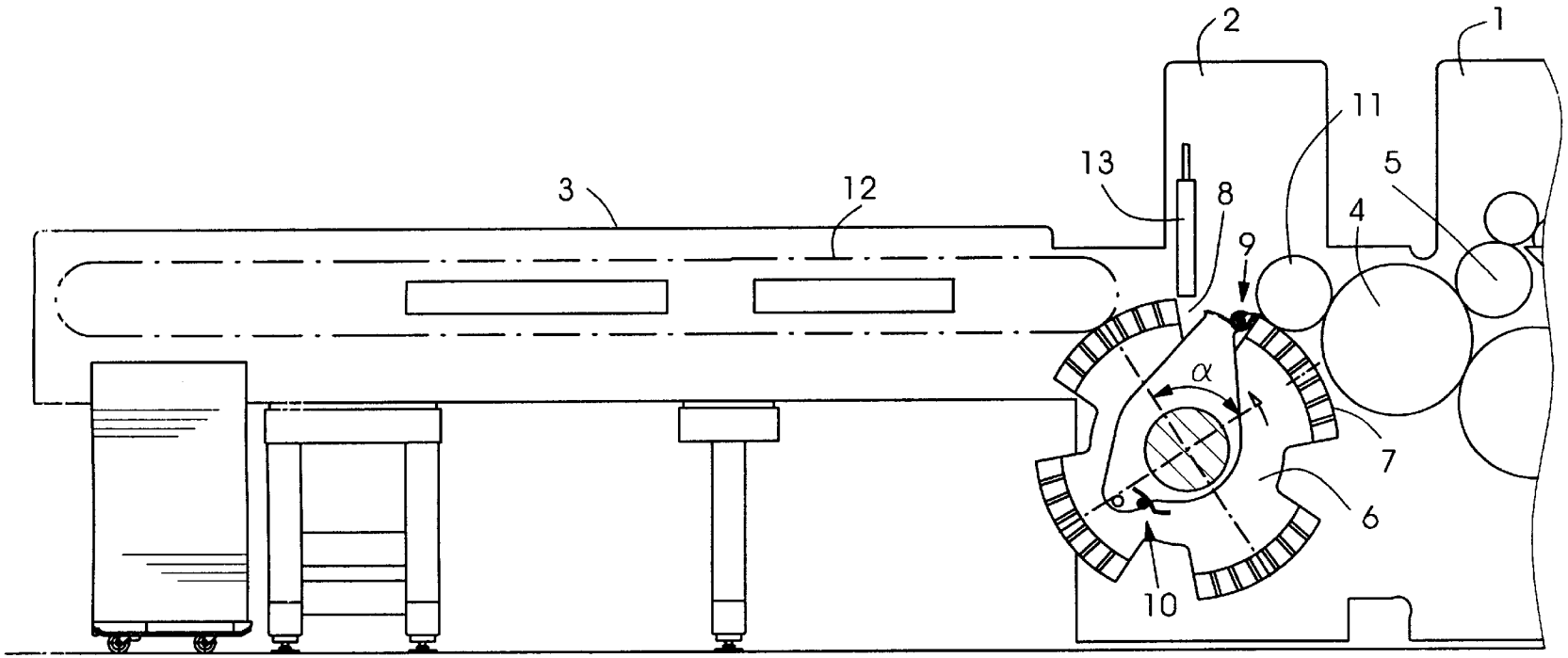
FIG. 1 shows a rotary printing machine with two printing units and a sheet delivery.

Referring now to the figures of the drawing in detail and first, particularly, to FIG. 1 thereof, there is shown a sheet-fed rotary printing machine of the inline type that includes a first printing unit 1, a second printing unit 2 located downstream of the latter, as seen in the sheet transport direction, and a sheet delivery 3. The first printing unit 1 may have a printing-form cylinder and/or a rubber-blanket cylinder according to various embodiments. In the version of the first printing unit 1 that is shown in FIG. 1, the first printing unit 1 is designed as a flexographic printing unit that includes a double-size impression cylinder 4 and a single-size further cylinder 5 which is capable of being thrown onto the latter and which is a printing-form cylinder.

In another possible version of the first printing unit 1, the first printing unit 1 can be an offset printing unit, and the further cylinder 5 can be a rubber-blanket cylinder.

The second printing unit 2 includes a transport device 6 in the form of a quadruple-size transport cylinder with four sheet bearing surfaces 7 and four circumferentially open cylinder gaps 8. The transport device 6 is designed to rotate about an axis of rotation 26 (axis indicated in FIG. 2). The sheet bearing surfaces 7 are in each case arranged so as to be offset from one another at a central angle $\alpha=90°$. Each of the sheet bearing surfaces 7 is assigned a holding device 9 for holding the leading edge of a print carrier sheet (not illustrated) that rests on the sheet bearing surface 7. Each one of the holding devices 9 is assigned, a cam mechanism 10 for adjusting the holding device 9. For the sake of greater clarity, only one of the four holding devices, each of which is arranged in one of the cylinder gaps 8, and one of the four cam mechanisms 10 are illustrated. A single-size feed cylinder 11 of the second printing unit 2 is interposed between the impression cylinder 4 and the transport device 6. The feed cylinder 11 takes over the print carrier sheet from the impression cylinder 4 and transfers it to the transport device 6, from which the print carrier sheet is transferred onto a chain conveyor 12 of the sheet delivery 3.

The feed cylinder 11 is followed, as seen in the sheet transport direction, by an NIP (Non-Impact-Printing) printing head 13 of the second printing unit 2. The printing head 13 is aligned with the circumferential surface of the transport device 6, that is to say with the sheet bearing surface 7. The NIP printing head 13 is arranged in a proximity to the transport device 6 such that the NIP printing head 13 almost touches the print carrier sheet that is transported past the NIP printing head 13 by the transport device 6. The NIP printing head 13 is designed as an ink-jet printing head, and imprints another imprint, such as, for example, an address, a bar code, a numbering or the like, onto each print carrier sheet that is transported past the NIP printing head 13 in succession within the printing cycle.

Figure 2:
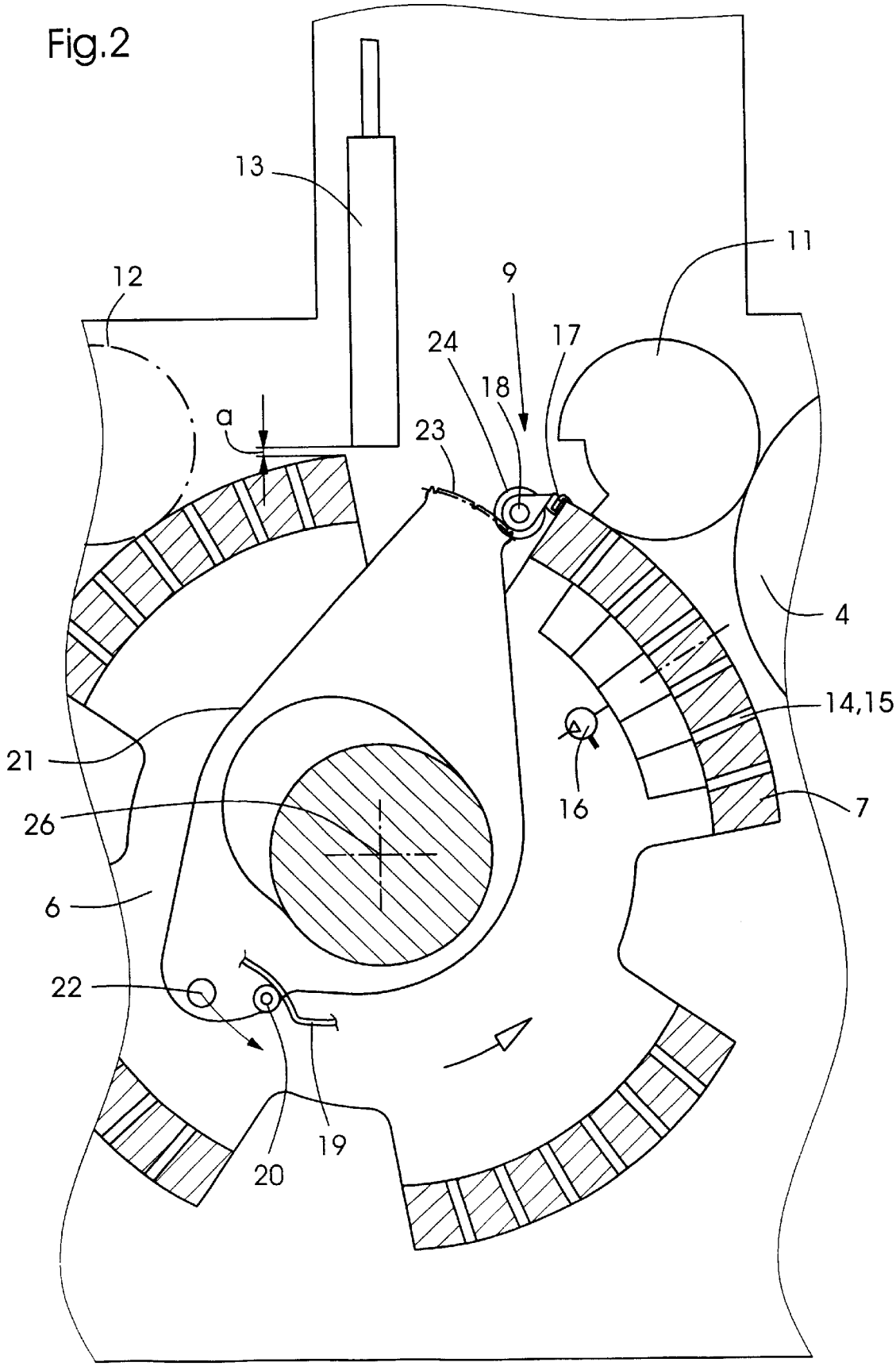
FIG. 2 shows a transport cylinder in a first position, a holding device, and a cam mechanism of one of the two printing units shown in FIG. 1.

FIG. 2 shows that, in addition to the holding device 9, the transport device 6 is equipped with a suction device 14 for sucking up the print carrier sheet. Each of the sheet bearing surfaces 7 is designed as a suction surface. Each one of the sheet bearing surfaces 7 are provided with suction orifices 15 that are designed in nozzle form and that are arranged in rows resulting in an orifice grid. The suction device 14 is connected to a motorized suction-air source 16, for example a suction fan. The suction orifices 15 are connected to the suction-air source 16 via an air guide system.

The holding device 9 is designed as a gripper system for clamping the print carrier sheet and consists of clamping jaws 17 that are arranged in a row axially parallel to the transport cylinder 6. The front edge of the sheet bearing surface 7 functions as a gripper support and is assigned to the clamping jaws 17. The clamping jaws 17 are pivotably mounted, by means of a gripper shaft 18 that is arranged in the cylinder gap 8, about their center axes axially parallel to the axis of rotation 26 of the transport device 6.

The clamping jaws 17 may project beyond the sheet bearing surface 7 in the radial direction by an amount that is greater than the distance a, which determines the printing nip, between the sheet bearing surface 7 and the NIP printing head 13 or its jet-nozzle surface. This is advantageous in terms of the design of the clamping jaws 17 which have high dimensional stability for generating high clamping forces. The high clamping force ensures a very high take-over and transfer register accuracy of the transport device 6, and eliminates the possibility of the print carrier sheet slipping out of place in the gripper system while the latter takes over the print carrier sheet from a gripper system of the preceding transport device, that is to say from the feed cylinder 11. The high clamping force also eliminates the possibility of the print carrier sheet slipping out of place in the gripper system while the latter transfers the print carrier sheet into a gripper system of a following transport device, that is to say the chain conveyor 12.

The cam mechanism 10, which is assigned to the holding device 9 for adjusting the latter into the interior of the transport cylinder 6, consists of a stationary control cam 19 arranged on a side wall of the second printing unit 2 and a cam roller 20 running on the control cam during the rotation of the transport device 6. The cam roller 20 is fastened to a rocker 21 which is fastened rotatably to the transport device 6 via a rotary joint 22. The rocker 21 is provided with a toothed segment 23 engaging into a toothed ring 24. The toothed ring 24 is arranged coaxially to the gripper shaft 18 and is connected fixedly in terms of rotation to the latter.

The second printing unit 2 functions as follows:

Immediately after the print carrier sheet has been taken over from the feed cylinder 11, the print carrier sheet is held on the rotating transport device 6 both by the holding device 9 and by the suction device 14. In this case, the holding device 9 projects beyond a circumferential contour 25 of the transport device 6, and the clamping jaws 17 press the print carrier sheet firmly against the sheet bearing surface 7 which is functioning as a gripper support. The gripper system is thus closed, with the print carrier sheet being clamped.

Figure 3:
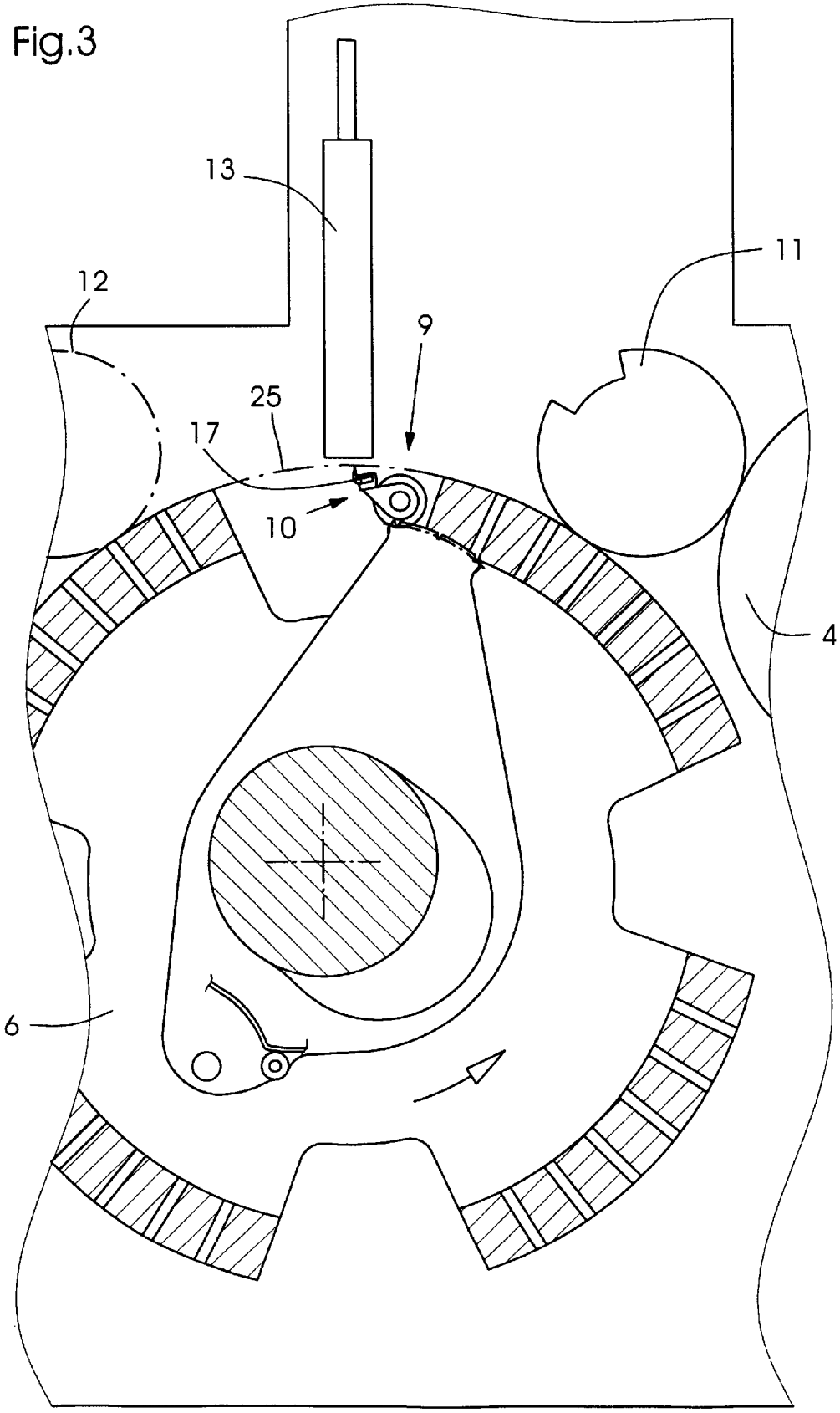
FIG. 3 shows the transport cylinder shown in FIG. 2 in a second position, the holding device, and the cam mechanism.

A rotary joint is formed eccentrically to the axis of rotation 26 of the transport device 6. When the holding device 9 approaches the NIP printing head 13 during the rotation of the transport device 6, the rocker 21 is pivoted about the rotary joint, in a manner counter to the direction of rotation of the transport cylinder 6 by the action of the control cam 19 and the cam roller 20. In this case, the toothed segment 23 runs on the toothed ring 24, with the result that the latter is rotated and the clamping jaws 17 are pivoted below the circumferential contour 25. As shown in FIG. 3, the holding device 9 has assumed its position below the circumferential contour 25 even before the holding device 9 comes opposite the NIP printing head 13 during the rotation of the transport device 6.

When the gripper system or its clamping jaws 17 are located in the interior of the transport device 6, the gripper system is opened and temporarily releases the print carrier sheet which is held solely by means of the suction device 14 during this time span. Because contactless printing is performed with the NIP printing head 13, no forces comparable to conventional printing methods, for example offset printing, are exerted on the print carrier sheet. Therefore, it is fully sufficient to hold the print carrier sheet, during contactless printing, on the transport cylinder 6 solely by means of the suction device 14. The vacuum of the suction device 14, which is effective in this case, can be set appropriately as a function of the print carrier thickness of the print carrier sheet to be processed in each case, by correspondingly activating the suction-air source 16.

Shortly after the holding device 9 has passed the NIP printing head 13, the cam mechanism 10 pivots the rocker 21 back into its original position, with the result that the holding device 9 is pivoted out of the cylinder gap 8 and projects beyond the circumferential contour 25 in the radial direction and such that the leading edge of the print carrier sheet is again clamped between the clamping jaws 17 and the sheet bearing surface 7. The gripper system is therefore closed even before the sheet is transferred from the transport device 6 onto the following transport device (chain conveyor 12).

It may be mentioned, finally, that, in any design of the sheet-fed rotary printing machine as a recto and verso printing machine (perfector), the sheet bearing surfaces 7 of the transport device 6 formed as a multiple-size transport cylinder can be designed to repel printing ink. For example, the sheet bearing surfaces 7 may be roughened and chromium-plated. The sheet bearing surfaces 7 may likewise be formed by plates or foils that are removable from the transport device 6 and that have an outer ink-repelling surface. The plates or foils, exchangeable for their maintenance, may have a hole pattern corresponding to the suction orifices 15, so that the suction devices 14 can suck up the print carrier sheets through the plates or foils. When, within the printing cycle, a side of the print carrier sheet is printed in at least one printing unit that precedes the second printing unit 2 of the sheet-fed rotary printing machine, and that side of the print carrier sheet faces the sheet bearing surface 7 during the printing of the print carrier sheet in the second printing unit 2, the ink-repelling surface of the sheet bearing surface prevents the not yet completely dried fresh printing ink from being smudged onto the sheet bearing surface 7.

I claim:

1. A printing unit comprising:

a rotatably mounted transport device for transporting a print carrier sheet; and a non-impact-printing printing head for printing the print carrier sheet, said printing head aligned with said transport device;

said transport device formed with an interior;

said transport device including a holding device for holding the print carrier sheet; and said holding device adjustably mounted to enable movement of said holding device into said interior of said transport device.

2. The printing unit according to claim 1, wherein said holding device is a gripper system.

3. The printing unit according to claim 2, wherein said gripper system is opened when said gripper system is in said interior of said transport device.

4. The printing unit according to claim 1, comprising a cam mechanism assigned to said holding device for moving said holding device into said interior of said transport device.

5. The printing unit according to claim 1, wherein said transport device includes a suction device for sucking up the print carrier sheet.

6. The printing unit according to claim 5, wherein:

said transport device has a sheet bearing surface; and said suction device has suction orifices that are arranged in rows and that are formed in said sheet bearing surface of said transport device.

7. The printing unit according to claim 5, comprising a suction-air source connected to said suction device.

8. The printing unit according to claim 7, wherein:

said transport device has a sheet bearing surface; and said suction device has suction orifices that are arranged in rows and that are formed in said sheet bearing surface of said transport device.

9. The printing unit according to claim 1, wherein said transport device is a transport cylinder.

10. The printing unit according to claim 1, wherein said printing head is an ink-jet printing head.

11. A sheet-fed rotary printing machine, comprising:

at least one first printing unit having an impression cylinder and cylinder selected from the group consisting of a rubber-blanket cylinder and a printing-form cylinder; and a second printing unit including:

a rotatably mounted transport device for transporting a print carrier sheet, and a non-impact-printing printing head for printing the print carrier sheet, said printing head aligned with said transport device, said transport device formed with an interior, said transport device including a holding device for holding the print carrier sheet, and said holding device adjustably mounted to enable movement of said holding device into said interior of said transport device.

* * * * *